US010335664B2

(12) United States Patent
Jacques

(10) Patent No.: US 10,335,664 B2
(45) Date of Patent: Jul. 2, 2019

(54) GOLF UTILITY DEVICE WITH BALL ALIGNMENT TOOL, DIVOT REPAIR TOOL AND RANGEFINDER

(71) Applicant: Guido Jacques, Natick, MA (US)

(72) Inventor: Guido Jacques, Natick, MA (US)

( * ) Notice: Subject to any disclaimer, the term of this patent is extended or adjusted under 35 U.S.C. 154(b) by 0 days.

(21) Appl. No.: 15/997,363

(22) Filed: Jun. 4, 2018

(65) Prior Publication Data

US 2018/0353830 A1 Dec. 13, 2018

Related U.S. Application Data

(60) Provisional application No. 62/517,759, filed on Jun. 9, 2017.

(51) Int. Cl.

| | |
|---|---|
| ***A63B 57/50*** | (2015.01) |
| ***A63B 57/30*** | (2015.01) |
| ***A63B 69/36*** | (2006.01) |
| *A63B 102/32* | (2015.01) |

(52) U.S. Cl.

CPC ..... *A63B 69/3676* (2013.01); *A63B 57/353* (2015.10); *A63B 57/50* (2015.10); *A63B 2069/3679* (2013.01); *A63B 2102/32* (2015.10)

(58) Field of Classification Search

CPC ... A63B 69/3676; A63B 57/353; A63B 57/50; A63B 2102/32; A63B 2069/3679; A63H 33/00; A63H 29/08

See application file for complete search history.

(56) References Cited

U.S. PATENT DOCUMENTS

| | | | | | |
|---|---|---|---|---|---|
| 2,781,202 | A * | 2/1957 | Odin | B62B 1/042 | 280/13 |
| 4,063,731 | A * | 12/1977 | Kitay | A24F 13/22 | 473/286 |
| 4,151,937 | A * | 5/1979 | Jarosh | A45C 11/00 | 224/666 |
| 4,535,987 | A * | 8/1985 | Dikoff | A63B 57/00 | 473/406 |
| 4,881,738 | A * | 11/1989 | Ayers | A63F 9/0869 | 273/153 S |
| 4,998,726 | A * | 3/1991 | Budnick | A63B 57/00 | 473/406 |
| 5,211,395 | A * | 5/1993 | Liao | A63B 57/207 | 473/391 |
| 5,370,394 | A * | 12/1994 | Huncaga | A63F 9/0838 | 273/153 S |

(Continued)

*Primary Examiner* — Steven B Wong

(74) *Attorney, Agent, or Firm* — Ronald R. Shea

(57) ABSTRACT

A golf utility device includes upper and lower baseplates and a ball alignment tool. The alignment tool is mechanically coupled with, but rotationally independent of, the upper and lower base plates. The alignment tool includes an upper surface with an arrow. Before putting, a golfer places the golf utility device on the green behind a ball that has been circumscribed with an annular ring, removes the ball, calculates the line of play, and aligns the arrow therewith. The ball is then returned to the green with the annular ring aligned by the arrow on the alignment tool. A golfer subsequently aligns his putt using the alignment of the annular ring. Additional golf tools may be attached to the upper or lower baseplates, including, but not limited to, a ball marker, a divot repair tool, a range finder, a spike wrench, a golf tee, and a fidget/focus device.

13 Claims, 13 Drawing Sheets

(56) References Cited

U.S. PATENT DOCUMENTS

| | | | | | |
|---|---|---|---|---|---|
| 5,419,551 | A * | 5/1995 | Hoyt | A63B 57/00 | 473/406 |
| 5,769,740 | A * | 6/1998 | Colangelo | A63B 55/10 | 473/408 |
| 6,220,973 | B1 * | 4/2001 | Hsu | A63B 57/207 | 473/408 |
| D807,977 | S * | 1/2018 | Lee | D21/789 | |
| 10,016,693 | B1 * | 7/2018 | Dowdy | A63H 33/003 | |
| 2003/0207730 | A1 * | 11/2003 | Braithwaite | A63B 57/207 | 473/408 |
| 2006/0009313 | A1 * | 1/2006 | Parks | A63B 57/50 | 473/408 |
| 2008/0161138 | A1 * | 7/2008 | Jacobs | A63B 69/3676 | 473/408 |
| 2008/0280701 | A1 * | 11/2008 | Wang | A63B 57/50 | 473/408 |
| 2012/0065002 | A1 * | 3/2012 | Cameron | A63B 57/50 | 473/408 |
| 2013/0217518 | A1 * | 8/2013 | Miller | A63B 57/50 | 473/406 |
| 2017/0326468 | A1 * | 11/2017 | Kinmont, Jr. | A63H 33/26 | |

* cited by examiner

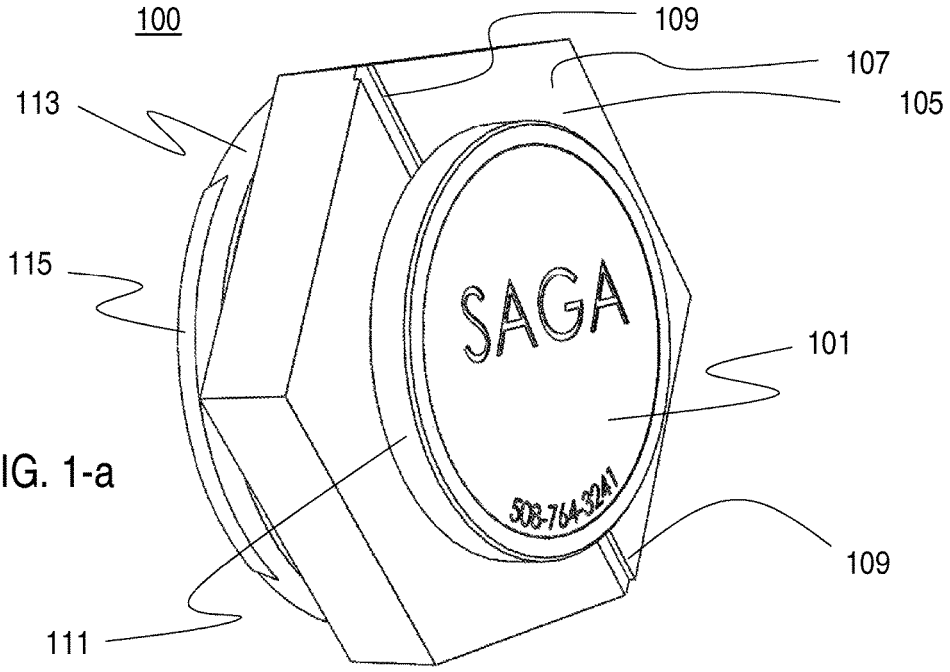
FIG. 1-a
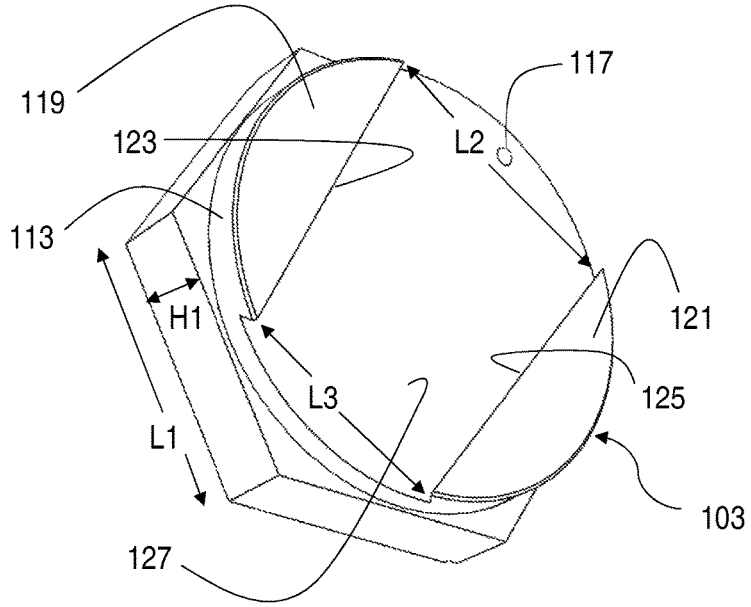
FIG. 1-b
100

FIG. 2-a
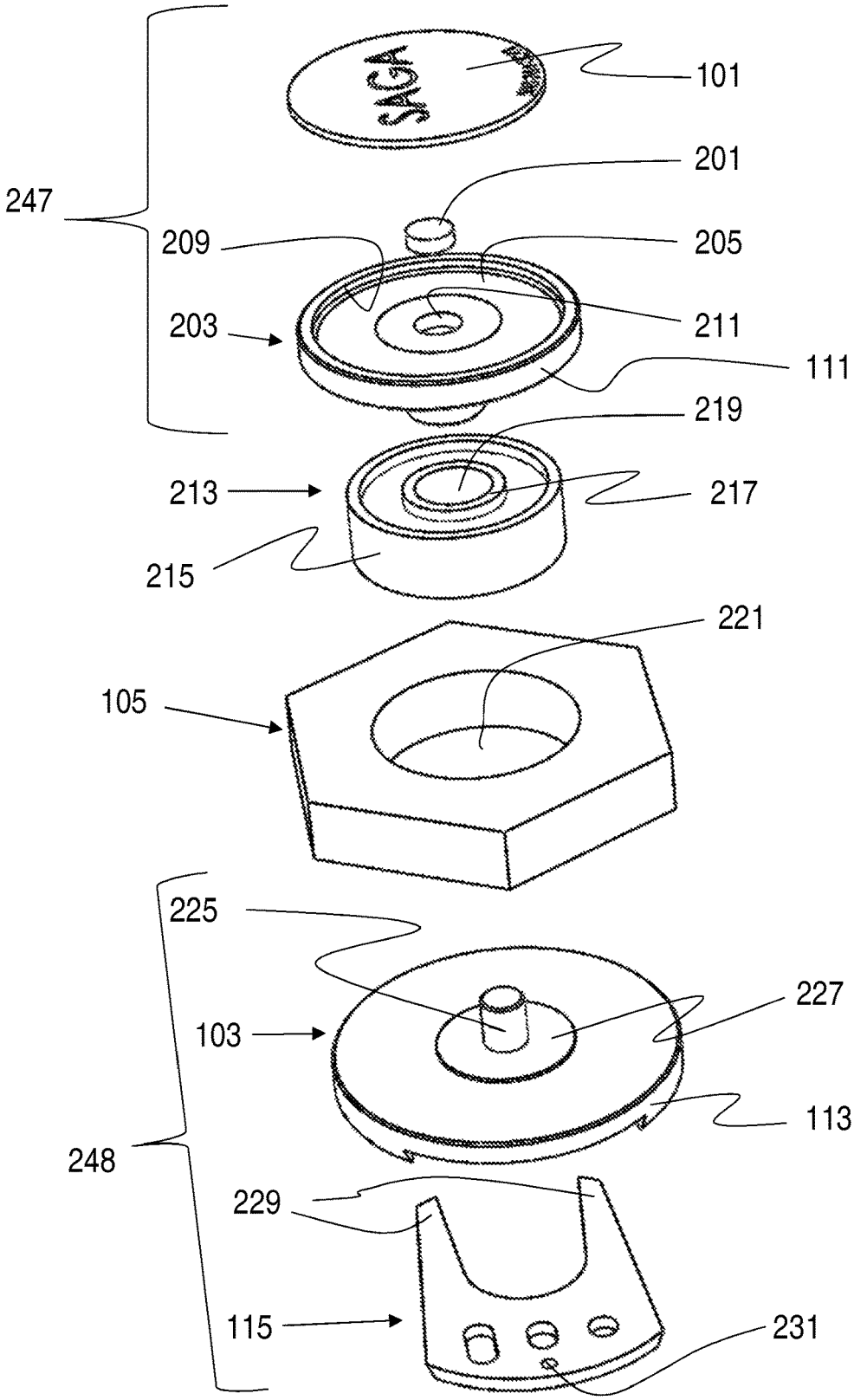

FIG. 2-b
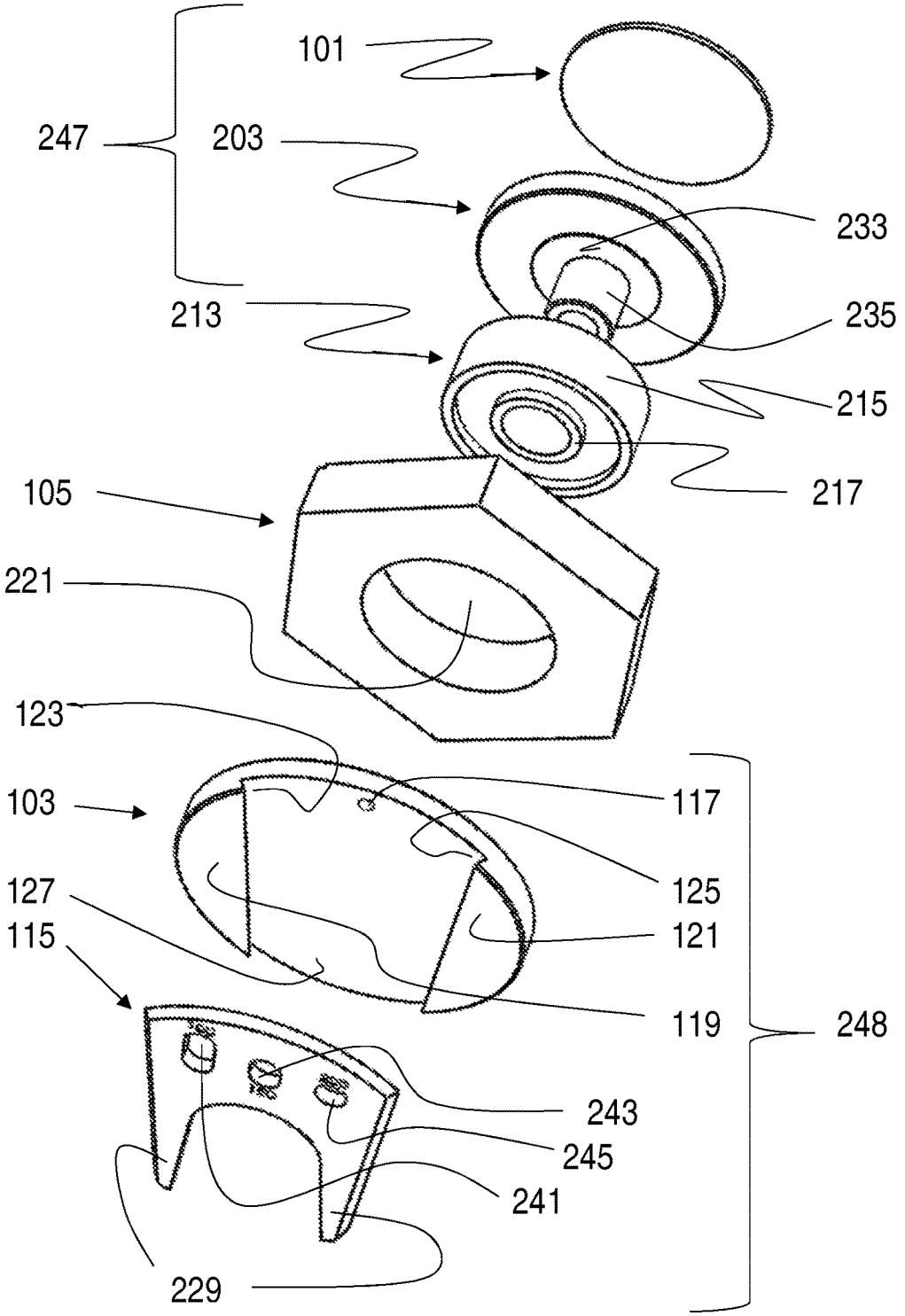

FIG. 3-a
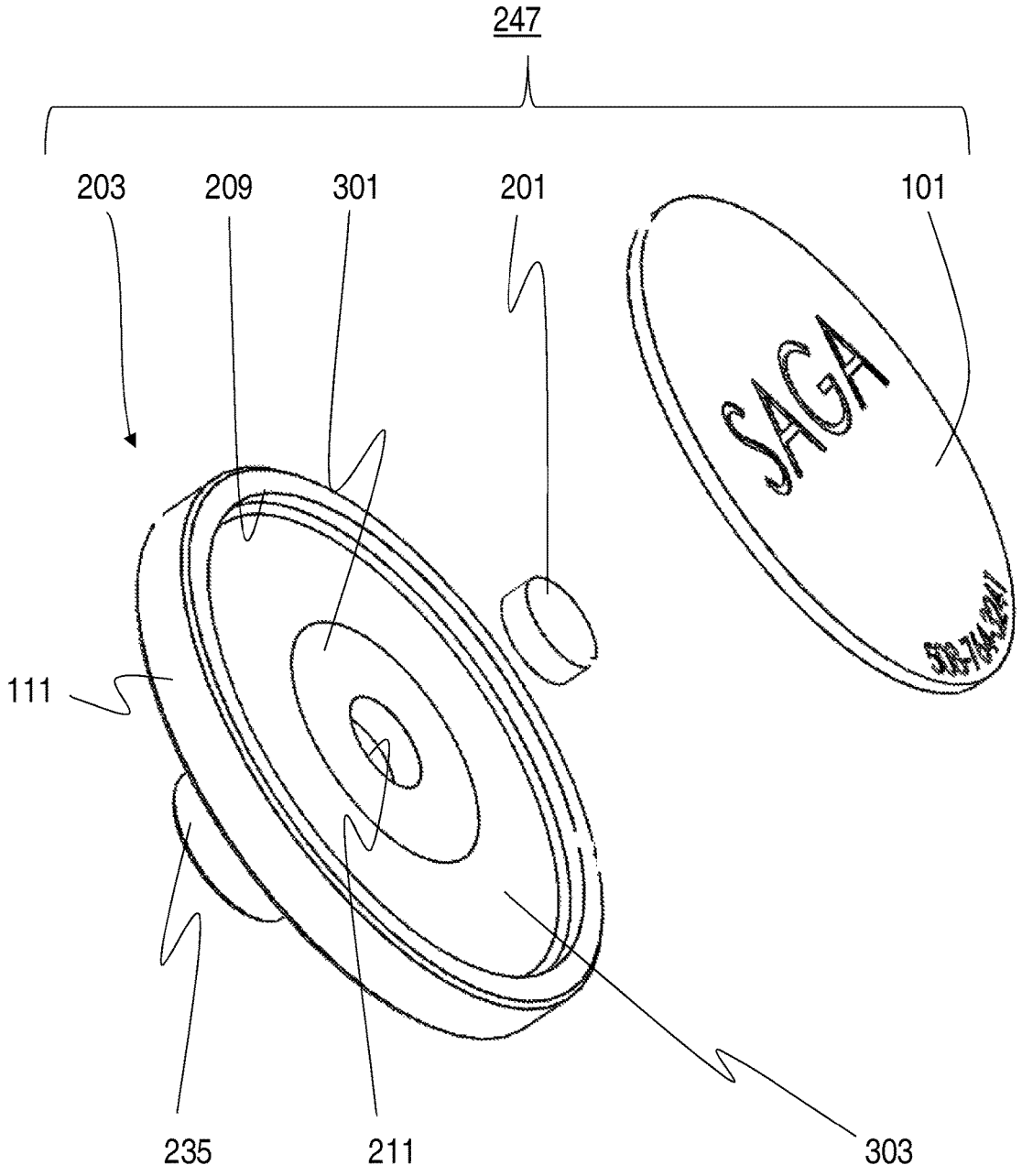

FIG. 3-b
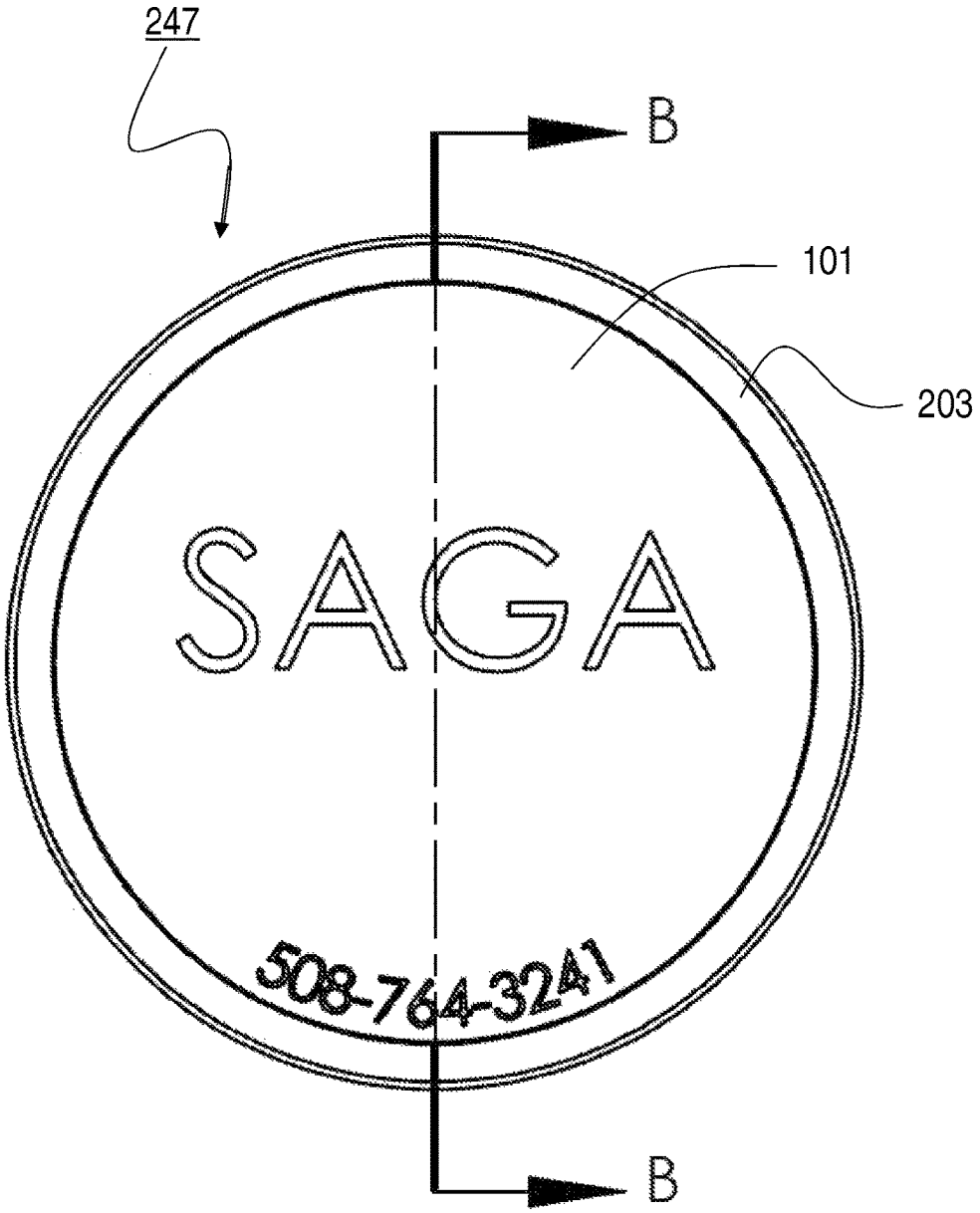

FIG. 3-c
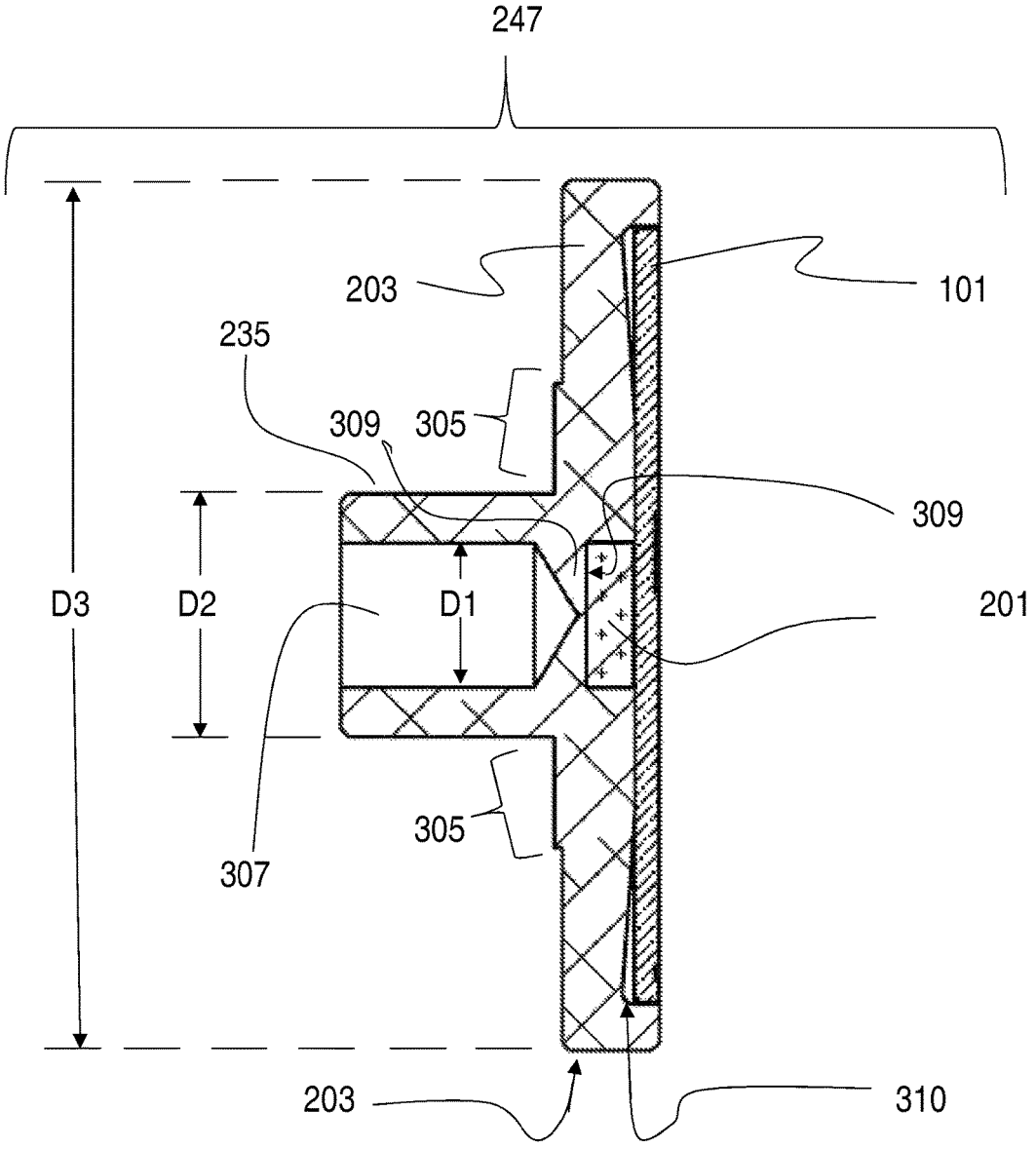
SECTION B-B

FIG 6-a
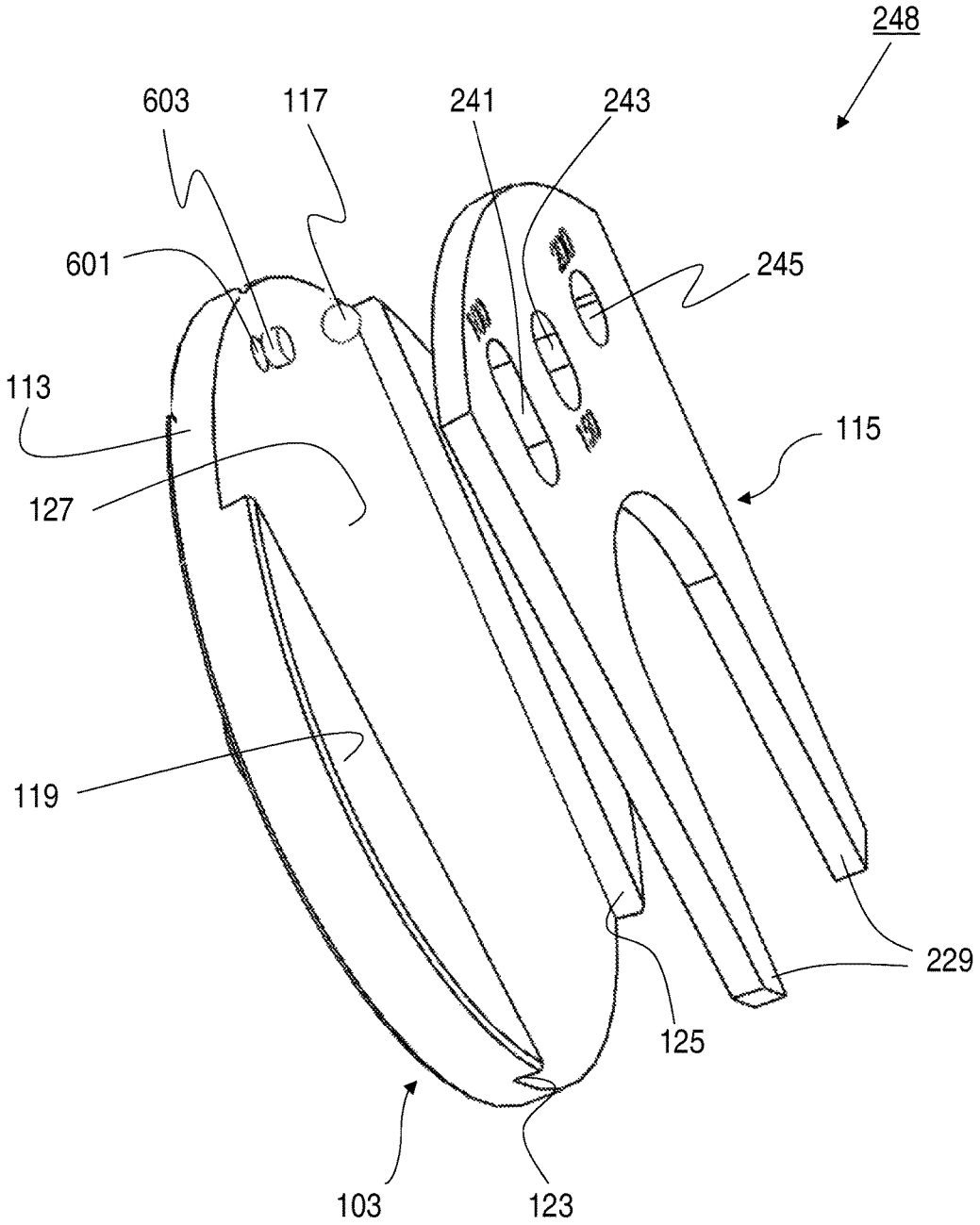

FIG 6-b
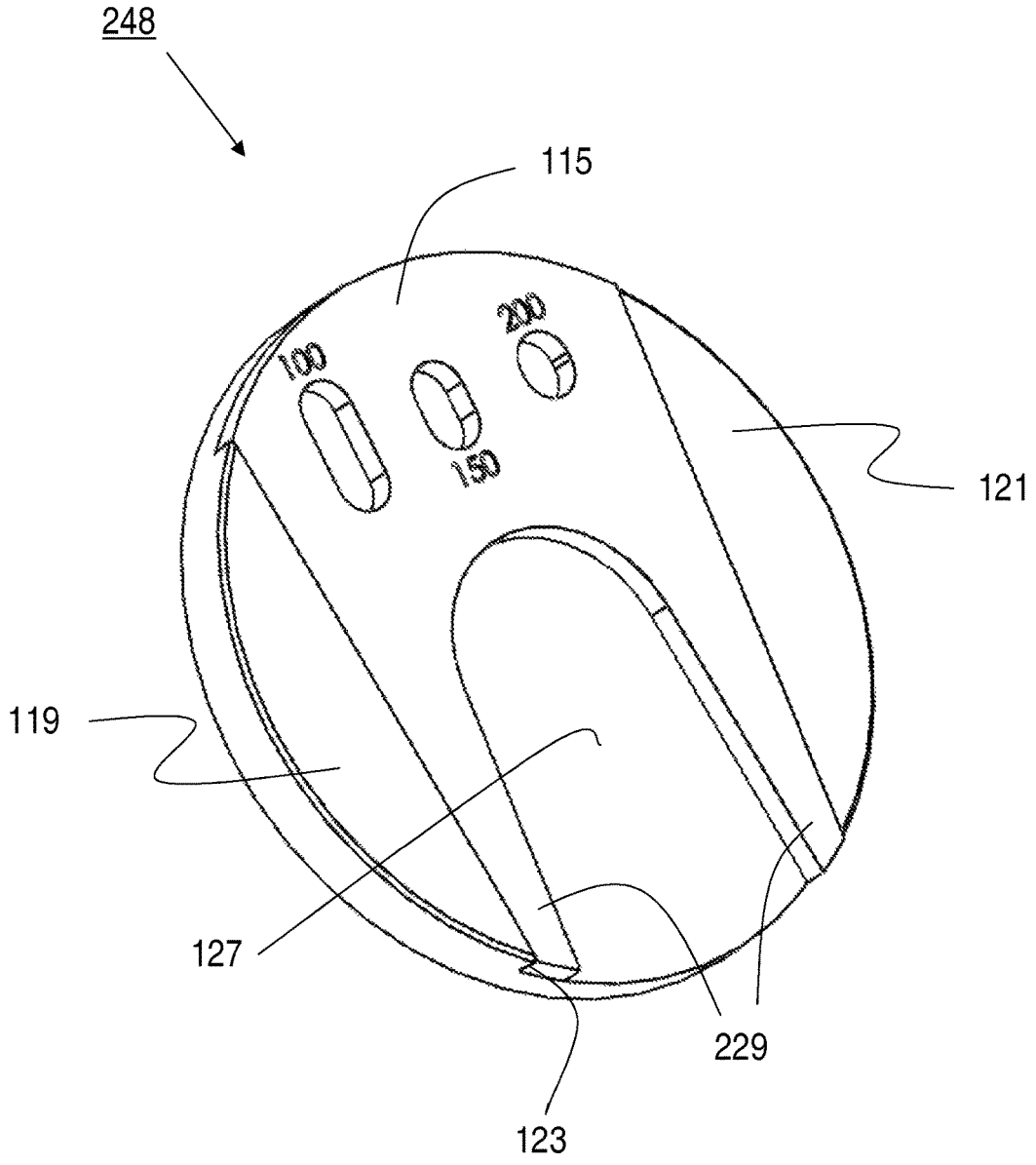

FIG 6-c
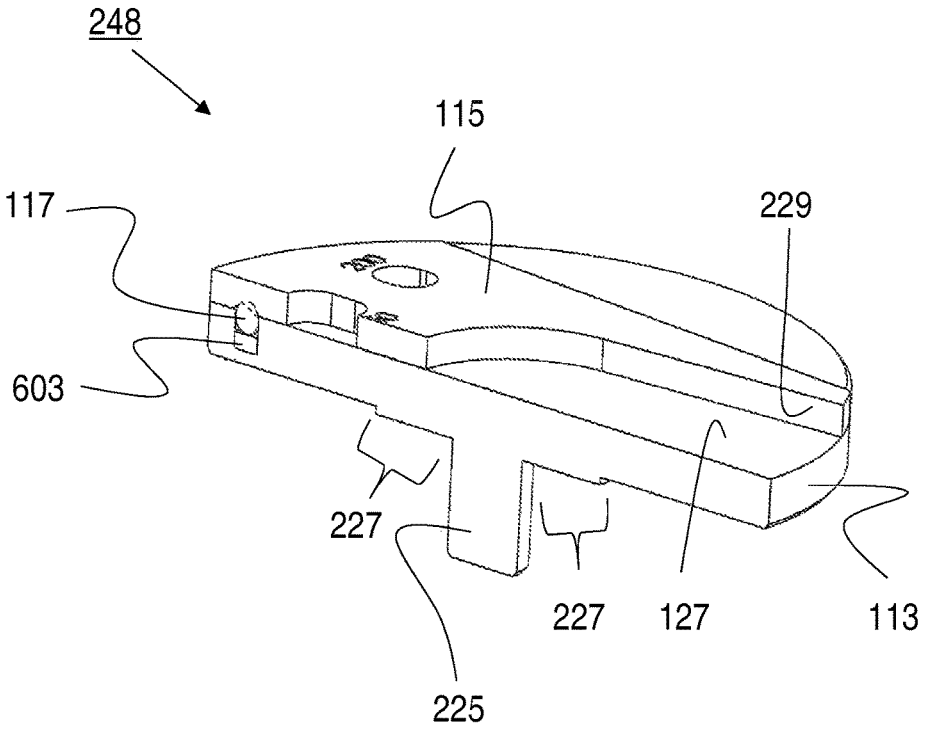

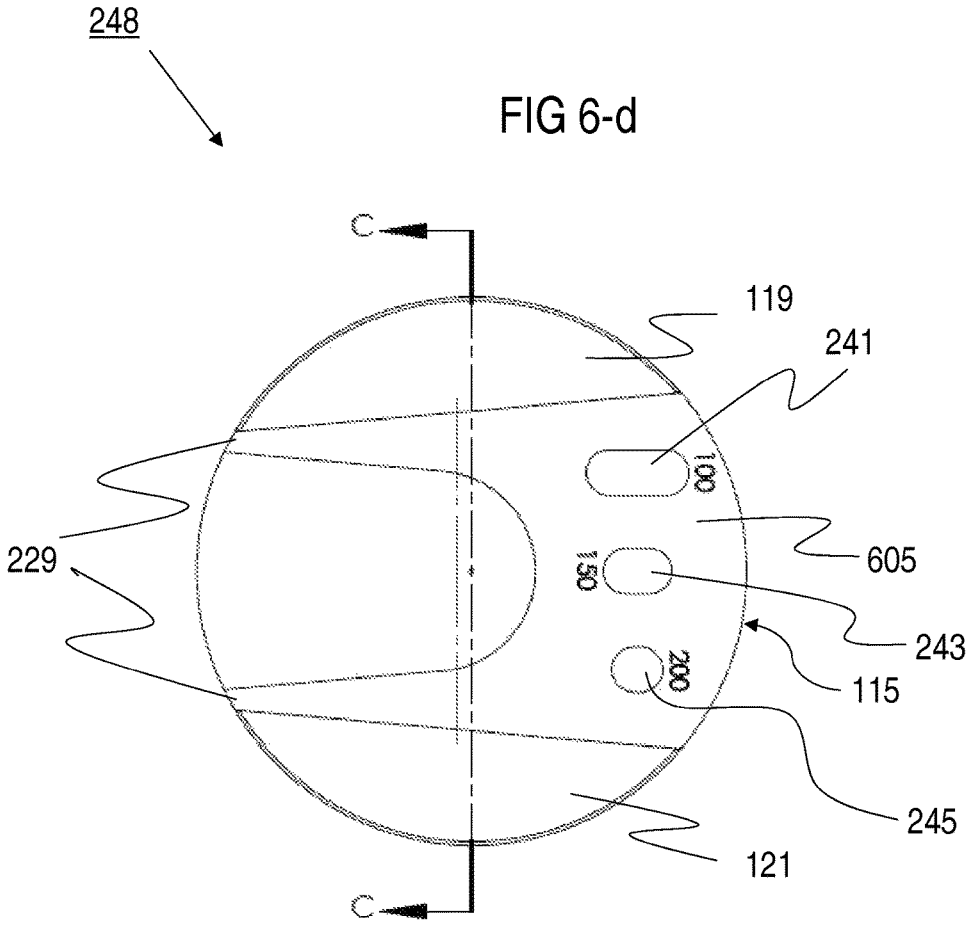
FIG 6-d

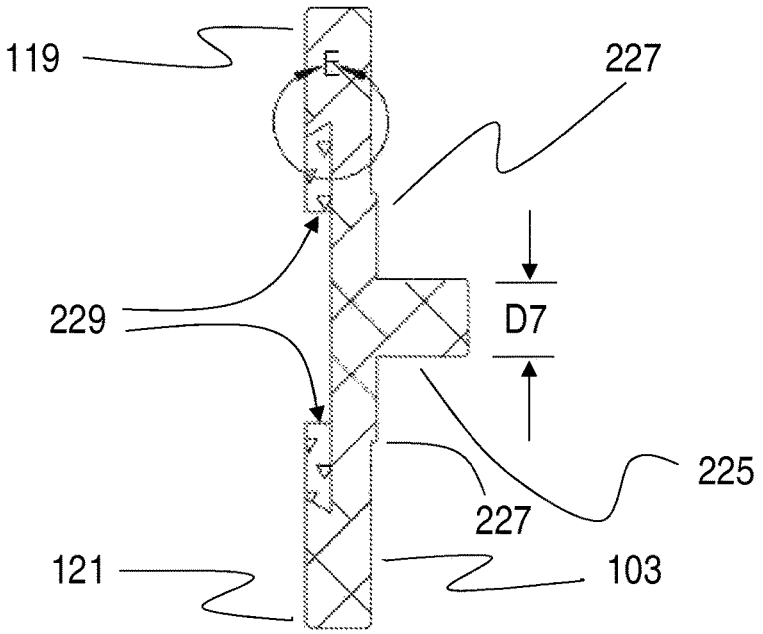
FIG 6-e
SECTION C-C
FIG 6-f
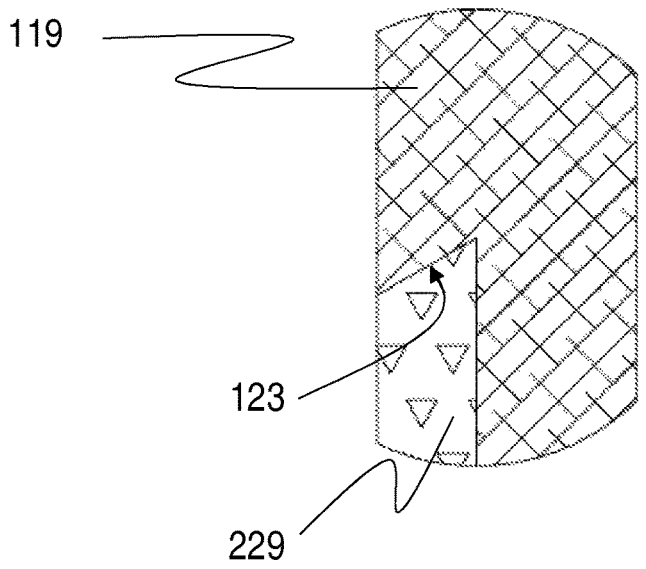
DETAIL E
SCALE 8 : 1

GOLF UTILITY DEVICE WITH BALL ALIGNMENT TOOL, DIVOT REPAIR TOOL AND RANGEFINDER

CROSS-REFERENCE TO RELATED APPLICATIONS

This application claims the benefit of priority from, and incorporates by reference in its entirety, U.S. Provisional Application No. 62/517,759, entitled, "A fidget device and spinning toy for use during the game of golf, including a novel front cap component which incorporates a temporarily removable golf ball position marker to facilitate proper game play" to Guido Jacques filed on Jun. 9, 2017.

BACKGROUND OF THE INVENTION

The "yips" is a condition that occurs in certain sports that require an overlearned motor skill, and typically manifests itself as uncontrollable twitches, staggers, jitters and jerks at a moment of high mental concentration that necessitates precise execution of the action. The yips are not known to be associated by any other neuro-muscular disorder, and typically occur in golfers who are fairly accomplished in the sport. Accordingly, they are commonly believed to be the product of "over thinking" when a player is intensely focused on an "over-learned" action that suddenly finds itself in conflict with his conscious and cognitive thought process. Although all golf shots require concentration and a precise execution of overlearned motor skill, not surprisingly, the yips most commonly manifest themselves on a putting green.

While observing a golfer in the act of putting, one will typically see the golfer's head turning back and forth between the cup, the ball, and the green in between, as the golfer tries "read the green" (i.e., to assess the slope and undulations, the grain, and the speed of the green), and the distance to the pin. Moreover, because greens are typically well manicured and of uniform texture, there is seldom a "spot" on the green—nearer the ball—at which the golfer may aim or align the put. Without this focus point, the ritual of looking back-and-forth to determine the break and align the put may go on for some time. The further the ball is from the cup, the greater rotation of the head is required, distracting the golfer, and interrupting the execution of a simple overlearned act.

Ideally, a golfer would benefit by placing a marker in the green to indicate the preferred line of play, particularly for a putt, thereby eliminating the distraction of repeatedly looking up (at the flag) and down (at his ball). However, when stroking the ball "on the putting green," USGA Rule 8-2(b) provides: "When the player's ball is on the putting green, the line of putt may be indicated before, but not during, the stroke by the player, his partner or either of their caddies; in doing so the putting green must not be touched. A mark must not be placed anywhere for the purpose of indicating a line of putt." Similarly, when striking the ball from any place "Other than the putting green," USGA rule 8-2(a) similarly asserts: "Any mark placed by the player or with his knowledge, for the purpose of indicating the line of play, must be removed before the stroke is made." Rule 16-1(a) further requires "The line of putt must not be touched except: [with exceptions noted, i through vii]."

There exists, therefor, a need for a method or apparatus for assisting a golfer to align a golf swing with the direction of the pin—particularly, but not exclusively, while putting—without placing a mark on the green.

A second problem facing golfers is that of club selection. Higher iron numbers (e.g., a nine-iron) produce more loft and less distance of ball travel. The lower the iron number (e.g. a 2 iron) the less loft, but greater distance of ball travel. Some golfers have used electronic rangefinders to determines the distance of a shot and select the correct club. However, USGA rule 14-3 also places limits on the use of electronic rangefinders in golf. While these limits may not affect the average golfer, the fact remains that most golfers cannot afford an electronic rangefinder. There exists therefore a need for a method or apparatus for calculating a distance on a golf course in order to select a proper club.

SUMMARY OF THE INVENTION

An embodiment of the novel apparatus described herein includes a small, and ideally, pocket sized, golf utility. The apparatus preferably includes a method or apparatus for assisting a golfer in aligning a putt or golf shot, and at least one other golf utility, including, but not limited to, a ball marker, rangefinder and a divot repair tool, spike tool, and/or a golf tee.

BRIEF DESCRIPTION OF THE SEVERAL VIEWS OF THE DRAWINGS

FIG. 1-*a* depicts a perspective top plan of the golf utility device in an assembled state according to a preferred embodiment of the claimed invention.

FIG. 1-*b* depicts a perspective bottom plan of the golf utility device of FIG. 1-*a* in a partially assembled state according to a preferred embodiment of the claimed invention.

FIG. 2-*a* depicts an exploded view of the golf utility device of FIG. 1-*a*, wherein the top side of each of the exploded components are visible from a perspective view.

FIG. 2-*b* depicts an exploded view of the golf utility device of FIG. 2-*a*, showing the bottom side of each of the elements from a perspective view.

FIG. 3-*a* depicts an exploded view of an embodiment of the cover assembly including the ball marker 101, upper baseplate 203, and magnet 201, as depicted in FIG. 2-*a*.

FIG. 3-*b* depicts a fully assembled top-plan of the cover assembly disclosed in FIG. 3-*a*.

FIG. 3-*c* depicts a cross-section of the cover assembly of FIGS. 3-*a* and 3-*b*, along the section line shown in FIG. 3-*b*.

FIG. 6-*a* depicts an exploded bottom perspective view of the divot repair assembly 248 of FIGS. 2-*a* and 2-*b*.

FIG. 6-*b* depicts a perspective bottom plan of the divot repair assembly of FIGS. 2-*a*, 2-*b* and 6-*a* in an assembled state.

FIG. 6-*c* depicts a cross sectional view of the divot repair assembly of FIG. 6-*b*.

FIG. 6-*d* depicts a bottom plan of the divot repair assembly of FIGS. 2-*a*, 2-*b*, 6-*a* and 6-*b* and 6-*c* in an assembled state.

FIG. 6-*e* depicts a cross sectional view of the divot repair assembly of FIGS. 2-*a*, 2-*b*, 6-*a*, 6-*b*, 6-*c* and 6-*d*, from the perspective of the section line shown in FIG. 6-*d*.

FIG. 6-*f* is a detailed segment of FIG. 6-*e*, enlarged, to more clearly depict the dovetail engagement of the divot repair tool and the lower base plate.

DETAILED DESCRIPTION

Figure 4:
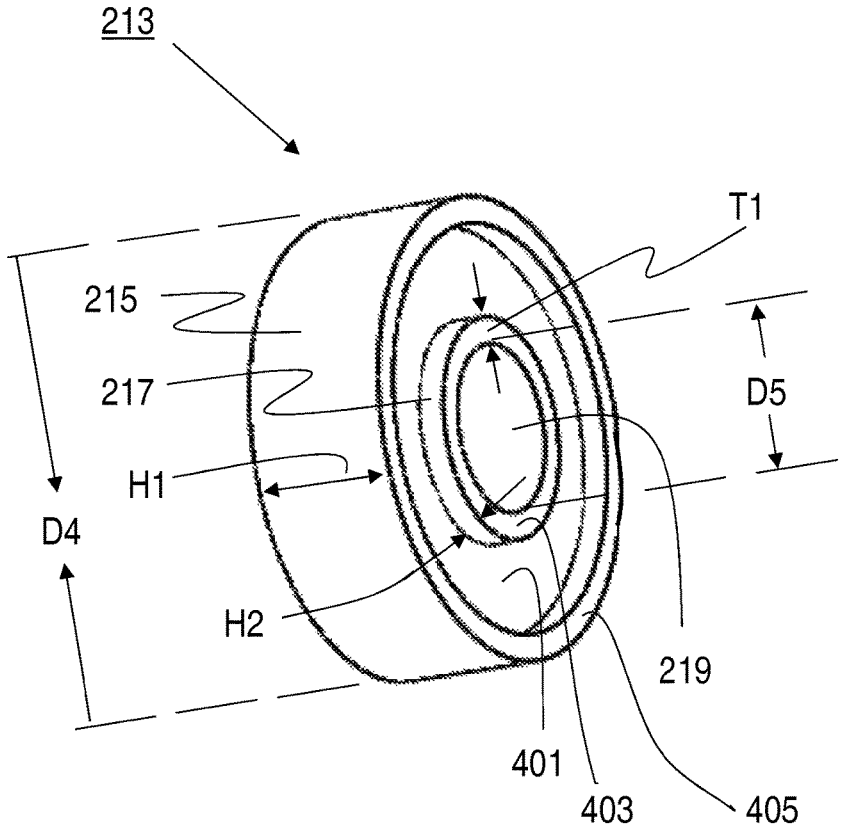
FIG. 4 presents a side perspective view of the ball bearing depicted in FIGS. 2-*a* and 2-*b*.

FIGS. 1-*a* and 1-*b*, depict top perspective and bottom perspective views of an embodiment of the golf utility apparatus 100 described herein from. To better disclose the design of the lower baseplate 103, the divot repair tool 115 has been excluded from the assembly of FIG. 1-*b*.

Overview

FIGS. 2-*a* and 2-*b* depict exploded views of the golf utility apparatus 100. FIG. 1-*a* discloses the top side of the components, and FIG. 2-*a* discloses the bottom side of the components. As discussed in greater detail below in conjunction with the other figures. the ball bearing 213 is press fit into the eye 221 of the ball alignment tool 105, frictionally securing the ball alignment tool to the outer sidewall 215 of the ball bearing 213, forming the centerpiece of the golf utility apparatus 100, thereby aligning the axis of rotation of the ball alignment tool with the axis of rotation of the ball bearing. See FIGS. 2-*a* and 2-*b*.

Still referring to FIGS. 2-*a* and 2-*b*, the cover assembly 247 disposed above the ball bearing 213 includes an upper baseplate 203 a magnet 201 and a ball marker 101. An alignment shaft 235 extends downward from the bottom surface of the upper baseplate 203. In assembly, the alignment shaft 235 is press fit into the eye 219 of the ball bearing 213, forming a secure frictional engagement between the alignment shaft 235 and the interior sidewall 217 of the ball bearing, and thereby aligning the axis of rotation of the alignment shaft with the axis of rotation of the ball bearing. Because the outer surface 215 and interior surface 217 of the ball bearing are rotationally independent of each other, the ball alignment tool 105 is rotationally independent of the cover assembly 247, which includes the upper base plate 203, the magnet 201 and the ball marker 101.

Referring briefly to FIGS. 3-*a* and 3-*c*, a lower bore hole 307 extends upward through the alignment shaft 235, terminating at an interior floor structure 309 that separates the lower bore hole 307 from the upper bore hole 211.

Still referring to FIGS. 2-*a*, 2-*b*, divot repair assembly 248 (below the ball alignment tool 105) comprises a lower baseplate 103 and a spindle 225 that extends upward into the lower bore hole 307 of the alignment shaft 235. Embodiments are envisioned in which the spindle is rotationally secured to the alignment shaft 235 through a press fit engagement, a threaded engagement, or other known securement means, thereby linking the rotation of the upper baseplate 203 to the rotation of the lower base plate 103 through mechanical interface.

The Ball Bearing

Referring now to FIG. 4, the ball bearing 213 comprises a cylindrical exterior sidewall 215, a cylindrical interior sidewall 217, and an upper floor 401 extending between the exterior and interior sidewalls.

The interior sidewall 217 extends above the floor 401 by a height H2, has a thickness T1. In an embodiment, the upper edge 403 of the interior sidewall comprises a substantially flat surface against which an adjacent structure may be abutted. The inner surface of the interior sidewall delimits the eye 219 of the ball bearing, which has a diameter D5.

The exterior sidewall 215 of the ball bearing has a total height H1, and an outer diameter D4. In an embodiment, the exterior sidewall 215 extends above the floor 401 by the same distance as the interior sidewall 217 (i.e., H2); comprises the same thickness as the interior sidewall (i.e. T1); and the upper edge of the exterior sidewall 215 also comprises flat surface 405.

Briefly comparing FIGS. 2-*a* and 2-*b*, in a preferred embodiment, the top and bottom sides of the ball bearing 213 have identical structures, such that one could flip the ball bearing in manufacturing without altering the design requirements.

The Ball Alignment Tool

Figure 5:
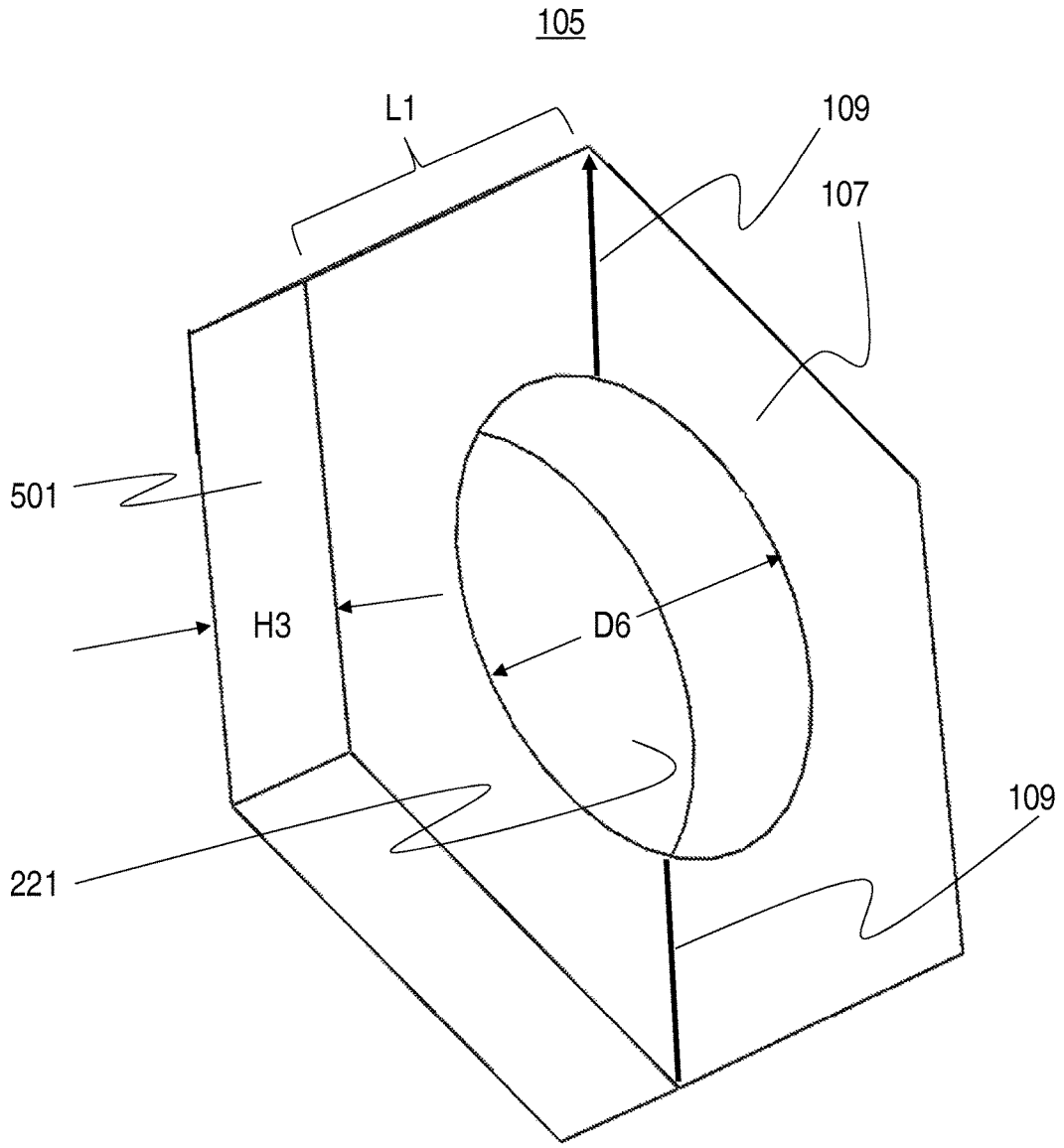
FIG. 5 depicts an embodiment of the ball alignment tool 105 depicted in FIGS. 1-*a*, 2-*a*, and 2-*b*.

Referring now to FIG. 5, the ball alignment tool 105 includes a rigid body with an eye 221 having a diameter D6, substantially matching the outer diameter D4 of the ball bearing 213. In a preferred embodiment the ball bearing 213 is press fit into the eye 221 of the ball alignment tool, thereby frictionally engaging the rotation of the ball alignment tool with the outer sidewall 215 of the ball bearing 213. In a preferred embodiment, the ball alignment tool is a polygon, and even more preferably a hexagon. The six sidewalls of the ball alignment tool have a height H1 and each wall has a uniform length L1. However, uniformity in the length of the sidewalls is not essential. Moreover, alternative embodiments are envisioned, including ball alignment tools that are cylindrical, disk shaped, or other geometric options. A ball alignment mark 109, such as a line or an arrow, is scored, engraved, etched, or otherwise permanently displayed the upper surface 107 of the ball alignment tool. In the embodiment depicted in FIGS. 1-*a*, 2-*a*, and 5, the ball alignment tool 105 comprises a flat upper surface on which a ball alignment mark 109 is printed or scribed. The ball alignment mark extends in a single geometric line on both sides of the eye 221, thereby giving a longer and therefore more precise, perception of alignment. As further depicted in FIGS. 1 and 6, the ball alignment tool 105 is preferably polygonal, and more preferably hexagonal, with sharp, well defined corners. The ball alignment mark 109 extends across the eye 221 from opposing corners of a hexagonal structure. As a consequence, two of the hexagonal sides are parallel to the alignment mark further reinforce the user's sense of alignment. FIG. 1 further depicts a deeply scored ball alignment mark 109 formed by appropriate tooling device, insuring that inadvertent scratches or marks on the surface of the ball alignment tool 105 will not serve to obscure the ball alignment mark 109 or distract the user's focus off of the alignment mark.

The Lower Baseplate

Referring momentarily to FIGS. 1-*b*, 6-*a*, 6-*e* and 6-*f*, in order to more fully disclose the bottom surface of the lower baseplate 103, the divot repair tool 115 of FIG. 6-*a* is not included in the assembly in FIG. 1-*b*. The lower baseplate 103 comprises an exterior circular sidewall 113. The bottom surface comprises two circle segment structures 119 and 121, a planar recess 123 extending between the circle segment structures, and a steel ball 117. Most of the steel ball 117 is recessed within the lower baseplate, but a portion dome shaped portion is visible extending beyond the surface of the recessed shelf 127. This partially recessed orientation allows the steel ball 117 to operate as the ball component of the ball detent.

When a line intersects a circle, the area within these geometric limits constitutes a circle segment. The portion of the line that lies between the two points of intersection is the chord, and the circumferential portion of the circle that extends between the two points is the arc. Referring still to the circle segment structures 119, 121 of FIG. 2-*b*, the chord of each structure is coextensive with each of the respective sidewalls 123, 125, and the arc of each of these two structures is coextensive with the portion of the outer sidewall that intersects the inner sidewall 113 (FIG. 1-*b*) in two places. The intersection of the outer wall and an inner wall forms an endpoint. Each circle segment structure 119, 121 thereby has two endpoints. The end points nearest to the ball bearing 117 are defined herein as the 'proximal' end points of each of the circle segment structures 119, 121, and the end points farthest from the ball bearing 117 are defined herein the 'distal' end points of the structures. The planar recessed shelf 127 extends between the two sidewalls 123, 125.

Still referring to FIG. 2-*b*, the distance L2 between the proximal endpoints of the first and second circle segment structures 119, 121 is greater than the distance L3 between the distal endpoints of these structures. The interior sidewalls 123, 125 thereby converge as one moves from the proximal endpoints to the distal endpoints of the circle segment structures 119, 122.

The Divot Repair Tool

Referring now to FIGS. 2-*a*, 2-*b*, 6-*a*, 6-*b*, 6-*c*, 6-*e* and 6-*f*, in a preferred embodiment, the divot repair tool 115 is machine tooled from a metal plate, optimally having a uniform thickness. The tool comprises a handle 605 (FIG. 6-*d*) with two tines 229 extending therefrom. The exterior edges of the tines 229 converge at an angle identical to the angle of convergence of the interior sidewalls 123, 125 of the lower baseplate 103, thereby allowing the divot repair tool to be securely wedged between the interior sidewalls of the lower baseplate 103.

Beveled Dovetail Engagement of the Tines with the Lower Baseplate

Referring now principally to FIGS. 1-*b*, 6-*d*, 6-*e* and 6-*f*, the interior sidewalls 123, 125 of the circle segment structures 119, 121 are not perpendicular to the recessed shelf 127, but intersect it at an acute angle, preferably between five degrees and eighty-five degrees, and even more preferably thirty and sixty degrees. In a preferred embodiment, an angle of about forty-five degrees is optimal.

FIGS. 6-*e* and 6-*f* are depictions of the lower baseplate 103 and divot repair tool 115 as viewed from the section line "c-c" of FIG. 6-*d*. Referring therefore to FIGS. 6-*e* and 6-*f*, the outer edges of the tines 229 are beveled at an angle configured to interface with the beveled angle of the inner sidewalls 123, 125 on the bottom of the lower baseplate 103 (FIGS. 1-*b*, 2-*b*, 6-*a*, 6-*e* and 6-*f*). When a user inserts the divot repair tool 115 between the opposing lower sidewalls 123, 125, the abutment of the beveled outer sidewall of the tines 229 with the beveled inner sidewalls 123, 125 of the lower baseplate 103 forms a dovetail engagement that secures the divot repair tool to the lower baseplate.

The Ball Detent Assembly

Referring to FIGS. 2-*a*, 6-*a* and 6-*c*, during manufacture, a ball detent assembly is formed in the lower baseplate 103, and a ball detent 231 (FIG. 2-*a*) is formed in the divot repair tool 115. Collectively, they form a ball detent snap-lock as described below. Referring to FIG. 6-*a*, the ball detent assembly comprises a locking bore 601, an elastomer 603 and a steel ball 117.

Referring to FIG. 6-*a*, during fabrication, a locking bore 601 is drilled into the recessed shelf 127 between the sidewalls 123, 125 of the lower baseplate 103. An elastomer 603 is inserted into the locking bore, and a steel ball 117 is inserted on top of the elastomer. To permanently secure the steel ball within the locking bore 601, a suitable die or punch-press is struck against the lower baseplate 103 in the area immediately surrounding the locking bore 601, deforming the steel surrounding the opening of the locking bore 601 to constrict the diameter of the opening to less than the diameter of the steel ball 117. This process traps the steel ball and the elastomer inside the locking bore 601. The locking bore 601, the elastomer 603 and the steel ball 117 are collectively referred to herein as the ball detent assembly.

The elastomer 603 may be comprised polyisoprene (natural rubber), polybutadiene (the synthetic rubber used in tires), polyisobutylene (the synthetic rubber first used in inner-tubes of tires), polyurethane (some forms of which are elastic), or any other suitable elastomer. Ideal properties include: i) good resistive strength so that, in restoring to its original shape, it can forcibly secure the steel ball 117 against the restricted opening of the locking bore. The diameter of the steel ball should be slightly smaller than the diameter of the bore so it is free move within the locking bore without undue friction, but larger than the opening of the locking bore so it cannot be ejected. As depicted in FIG. 6-*a*, in an embodiment, the elastomer may be cylindrical shape, matching the topology of the locking bore. However, alternative shapes are envisioned, including, but not limited to, a sphere, a disk shape, a polygon, or a star.

Referring briefly to FIG. 2-*a*, a ball detent 231 is formed in the divot repair tool 115 during assembly by suitable means, such as a punch press or die stamp.

Referring principally to FIGS. 1-*a*, 2-*a*, 2-*b*, 6-*a* and 6-*b*, to secure the divot repair tool to the lower baseplate, the user guides the tines 229 of the divot repair tool 115 between the sidewalls, 123, 125 of the lower baseplate 103, advancing the divot repair tool across the surface of the recessed shelf 127. The dovetail engagement of the tines 129 and the sidewalls 123, 129 presses the face of the divot repair tool against the recessed shelf 127. As the divot repair tool 115 crosses over the steel ball 117, this process forcibly depresses the steel ball 117 into the locking bore 601 of the lower baseplate 103. Upon full insertion of the divot repair tool into the "wedge" of the opposing sidewalls, the force of the elastomer 603 against the steel ball forces the ball upward into the ball detent 231 of the divot repair tool 115, forming a snap-fit engagement between the lower baseplate and the divot repair tool. The thickness, shape, and material of the elastomer are selected to produce a ball detent assembly that can press the steel ball against the constricted opening with sufficient force to secure the divot repair tool 115 to the lower baseplate 103 with sufficient force that the divot repair tool will not slip out of place unless forcibly slid out by the user. This relationship is illustrated in FIG. 6-*c*, which depicts a cross sectional view of a the divot repair assembly, wherein the steel ball 117 is resting upon the elastomer 603 within the locking bore 601; the divot repair tool lies flat against the recessed shelf 127 of the lower baseplate; and the top portion of the steel ball is forcibly pressed above the plane of the recessed shelf and into the ball detent 231 formed in the divot repair tool 115.

The Divot Repair Assembly

The divot repair tool 115 is removably secured to the lower baseplate 103 form the divot repair assembly 248. Referring briefly to FIGS. 1-*a*, 2-*a*, 6-*a* and FIG. 6-*b*, the wedge formation of the interior sidewalls 123, 125 requires that an engagement of the divot repair tool 115 with the lower baseplate 103 is affected by sliding the tines 229 of the divot repair tool 115 between the sidewalls 123, 125, commencing at the proximal tips of the sidewalls. FIG. 6-*d* depicts a bottom plan of the divot repair assembly 248 wherein the divot repair tool 115 is fully inserted into the lower baseplate 103. Because an exterior side of each tine 229 is beveled, parallel to the respective sidewall 123, 125 with which it engages, when the divot repair tool 115 is fully inserted between the sidewalls 123, 125, the wedge-shaped engagement forms a snug fit.

The wedge shaped convergence of the sidewalls 123, 125 prevents the over-insertion of the divot repair tool 115. The dovetail engagement, FIGS. 6-*e*, 6-*f*, prevents the divot repair tool from falling out from between the sidewalls. And the ball detent assembly prevents the baseplate 103 from inadvertently discharging the divot repair tool 115 without a user applying sufficient force to depress the steel ball into the elastomer such that the top of steel ball is no higher than the plane of the recessed shelf 127.

Curved to Match the Circumference of the Lower Baseplate

Still referring to FIG. 6-*d*, the exterior edges of the divot repair tool 115 that are not abutting the sidewalls 123, 125 are tooled to match the curvature of the exterior sidewall 113 of the lower baseplate 103. When the divot repair tool 115 is fully inserted between the interior sidewalls 123, 125 of the lower baseplate 103, the exposed exterior edge of the handle 605 and the exposed tips of the tines 229 thereby form a flush surface with the exterior sidewall 113 of the lower baseplate 103.

Use of the Divot Repair Tool

When a golf shot lands on a green from an iron shot, the impact often causes a crescent shaped crater on the green perpendicular to the line of impact. It is common courtesy in golf to repair a crater or "ball mark" caused by one's own ball. However, if an earlier golfer has failed to repair a ball mark, USGA Rule 16-1(a)(vi) provides: "The line of putt must not be touched except: . . . (vi) in repairing old hole plugs or ball marks on the putting green . . . "

Referring briefly to FIG. 6-*d*, the tool with which this repair is performed is often called a "divot repair tool" 115, and embodiment of which is presented in FIGS. 2-*a* and 6-*a*. The divot repair tool 115 comprises a handle 605 and two tines 229 which the user may stick in the ground at the far edge of the crescent crater, and tilt the tool backwards using the earth as a fulcrum, loosening and further raising up the elevated crescent of sod before pressing it back down with one's fingers or shoe, thereby removing the elevated impact bump from the green.

Range Finder

Referring principally to FIGS. 6-*a*, 6-*b* and 6-d, in a preferred embodiment, the divot repair tool 215 comprises vertical slots 241, 243 and 245, which are used for determining the distance to the flag. Holding the tool a predetermined distance from his eye (e.g., one foot), the golfer aligns the pin within the various slots. If the height of the flag coincides with the height of a slot, the value embossed or inscribed adjacent to the slot informs the golfer of the number of yards to the pin. Knowing the distance to the pin is a key to proper club selection.

The Interface Shelf and Spindle

Referring briefly to FIGS. 2-*a* and 6-*a*, and 6-*c*, on the lower baseplate, on the opposite surface as the circle segment structures 119, 121, a circular raised interface shelf 227 extends outward from the lower baseplate. In the middle of the raised interface shelf, a spindle 225 extends further outward. In a preferred embodiment, the spindle 225 and the lower baseplate 103 are machine tooled from a single piece of steel. As discussed below, the spindle and the raised interface shelf are used in the final assembly of the golf utility device 100 described herein.

The Cover Assembly

Referring principally to FIG. 3-*a*, but also to FIGS. 1-*a*, 2-*a*, 2-*b* 3-*b* and 3-*c*, the cover assembly 247 comprises a ball marker 101, an upper baseplate 203, and a magnet 201. In a preferred embodiment, the ball marker 101 is flat and rigid.

The upper baseplate 203 is comprised of top and bottom surfaces. The upper surface has a floor with a central planar floor section 301 surrounded by an annular beveled floor section 303. A circular sidewall 111 has an exterior diameter D3 circumscribing the upper baseplate 203, and extends upward beyond the beveled floor section 303. The interior surface of the sidewall includes one or more grooves 209 circumscribing the interior surface. An upper borehole 211 extends downward from the center of the planar floor section 301, and is preferably formed through machine tooling. The upper borehole has at a fixed depth that terminates at a floor 309 (FIG. 3-*c*) separating the upper borehole 211 from the lower borehole 307—discussed below.

Referring to FIGS. 3-*a* and 3-*c*, and referring now to the bottom surface of the upper baseplate, a circular stair-step interface shelf 233 extends downward from the bottom surface of the upper baseplate 203, and an alignment shaft 235 having an outer diameter D2 extends downward from the circular stair-step interface 233. A lower borehole 307 having a diameter D1 is press fit into the center of the alignment shaft 235. As noted above, the lower borehole 307 terminates at the structure 309 that separates the upper borehole 211 from the lower borehole 307. The structure 309 can be conceptually regarded as the 'floor' of the upper borehole 211, or the 'ceiling' of the lower borehole 307.

In a preferred embodiment, the sidewall 111, the planar floor section 301, the beveled floor section 303, and the alignment shaft 235 are integrally formed from a single piece of steel through machine tooling. However, other solid structures are envisioned, including but not limited to various metal alloys, composites, ceramics, thermoplastics, and combinations thereof.

The Magnet

Referring to FIGS. 2-*a*, 3-*a* and 3-*c*, during manufacture, the magnet 201 is press fit, cemented, glued, sonic welded, wedged, or otherwise secured to the floor 309 of the upper borehole 211. In the embodiment depicted in FIG. 3-*c*, when the upper baseplate 203, the magnet 201 and ball marker 101 are fully assembled, the magnet 201 and the planar floor section 301 preferably form a contiguous planar region. In alternative embodiments however, the top of the magnet 201 may rise above, or be recessed below, the planar section 315 of the floor. Embodiments are envisioned in which the ball marker 101 may be held in place by the magnet 201, by the ridges 209 along the inner sidewall, or by a combination of these.

Referring to FIG. 3-*c*, when the ball marker 101 and magnet 201 are in place, a wedge-shaped gap 310 is formed between the bottom surface of the ball marker 101 and the beveled floor section 303. To remove the ball marker 101 from the upper baseplate, the user places his finger on the edge of the marker, and pushes downward through the gap 310 until the edge of the ball marker 101 meets the tapered outer floor. Since the ball marker is rigid, as one side of the ball marker pivots downward, the magnet acts as a fulcrum, causing the other side of the ball marker to rise up, whereupon the user can grip the edge extended above the sidewall 111 and manually remove the ball marker 101 from the cover assembly.

Use of the Ball Marker:

When putting on a green, standard courtesy usually grants the player whose ball is farthest from the pin to putt first. Oftentimes, however, a ball nearer the pin will be in the "line of putt." To remove one's ball as an obstacle on the putting green, it is common courtesy for a golfer to place a flat ball marker immediately behind his ball, and pick up his ball, thereby giving his opponent a free line-of-play to the pin. After the most remote player has putted, the player nearer the pin replaces his ball immediately in front of his ball marker, and remove the ball marker from the green.

Because a ball marker should not obstruct another ball when putt, a ball marker is generally flat, rather thin, and sometimes shaped like a very tiny and narrow Frisbee so that a putt crossing over the ball marker does not bounce when it strikes the sidewall of the ball marker. The ball marker 101 in the cover assembly 247 is therefore preferably flat, and thin enough that if a moving golf ball rolls over the ball marker, the golf ball will experience minimal disturbance as it rolls toward the pin.

Assembly

In assembly, the alignment shaft 235 of the upper baseplate 203 is inserted through the eye 219 of the ball bearing 213 from above, until the upper circular stair-step interface shelf 233 abuts the upper ledge 403 of the inner sidewall 217 of the ball bearing 213 (FIGS. 2-*a*, 2-*b*, 3-*c* and 4).

Similarly, the spindle 225 protruding from the lower base plate is inserted from beneath the eye 219 of the ball bearing 213 and into the lower borehole 307 of the alignment shaft 235. The upper and lower baseplates 103, 203 are then press fit together, forcibly inserting the spindle 225 into the lower borehole 307 of the alignment shaft, until the lower stair-step interface shelf 227 of the lower baseplate forcibly abuts the lower edge of the interior sidewall 217.

Alternative Assembly Embodiments

In the foregoing embodiment, the spindle 225 of the lower baseplate 103 is inserted into the lower borehole 307 of the alignment shaft 235, and fixedly coupled therewith through a mechanical coupling such as threaded engagement, frictional engagement, or other known means of mechanical coupling). As a result, upper and lower baseplates are mechanically joined to rotate in unison.

In an alternative embodiment, the upper baseplate 203 is mechanically joined to the ball marker 105 through known means including, but not limited to, epoxy or other chemical cement, solder, welding, sonic welding, frictional engagement, threaded engagement, sawtooth engagement, or tongue and groove engagement. The interposition of a ball bearing between the ball alignment tool 105 and the lower baseplate 103 ensures the independent rotation of the ball alignment tool and the lower baseplate. By mechanically coupling the rotation of the upper baseplate 203 to the rotation of the ball alignment tool 105, the upper baseplate 203 rotates with the ball alignment tool 105, and independently from the lower baseplate 103.

In any embodiment, when the lower baseplate or any other tool or structure is placed on the green, the ball alignment tool 105 must be mechanically coupled to the lower structure, but rotatably independent of it.

The Use of the Ball Alignment Tool

Referring now to FIG. 5, according to the rules of golf, a golf ball may be lifted from the green if a ball marker is first placed immediately behind the golf ball. Although a ball marker is usually small and flat, the rules do not define the shape or size of a ball marker, allowing a golfer to place the entire golf utility tool 100 behind the golf ball and remove the ball—provided it is removed from the green before play continues. To align a putt, a player places the golf utility device 100, which includes the ball alignment tool 105 behind his golf ball, and removes his golf ball to study the green. Because the bottom surface of the lower baseplate 103 rests against the green, the lower baseplate is restricted from rotating. However, the ball alignment tool 105 is secured to the outer sidewall 215 of the ball bearing 105, which is free to rotate independently of the upper 203 and lower 103 baseplates.

Many golf shops now sell scribing kits for scribing (marking) an annular ring around a golf ball. A most common use is to prevent a golfer from mistaking his ball from another ball. According to an embodiment of the present invention, however, the annular scribing of a golf ball may be used in conjunction with the ball alignment tool.

In practice, after placing the golf utility apparatus 100 on the green behind the ball, the user will remove his golf ball from the green, study the grain, slope, and speed the wind, and other variables that influence the line of the putt. After formulating an opinion about the line of the putt, the user will rotate the ball alignment tool 105 until the alignment mark 109 on the upper surface 107 of the ball alignment tool 105 is pointing in the direction of the line of putt that the golfer has mentally calculated.

When the golfer returns the golf ball to the green, he aligns the annular ring of the golf ball in the same line as the alignment mark 109 on the upper surface 107 of the ball alignment tool 105, and removes the golf utility device 100. The golfer then aligns the stroke of his putt with the annular mark circumscribing his golf ball, sparing the golfer the distraction of twisting his head back and forth from the flag to his ball to align the putt.

The foregoing specification and accompanying drawings include many specific details for specific embodiments described herein. These details should not be construed to narrow the scope of the appended claims, which envision alternative embodiments which may not be as detailed. Those skilled in the art will appreciate that alternative embodiments are possible without departing from the spirit and scope of the appended claims. These alternative embodiments may incorporate or substitute other useful golf tools, including, but not limited to, a spike wrench, a golf tee, a fidget and focus device for diverting the nervous energy of a golfer without unduly diverting his mental focus from the game, and combinations thereof.

What is claimed is:

1. A golf utility apparatus comprising first and second rotational members configured to rotate at a fixed distance from each other, wherein:

a. the first rotational member comprises a ball alignment tool for assisting a golfer to align a putt;

b. the second rotational member has at least one golf tool removably coupled therewith, wherein said at least one golf tool is selected from among a group of golf tools consisting of a divot repair tool, a range finder, a spike wrench, a ball marker, a golf tee, a fidget/focus device, and combinations thereof; and c. a third rotational member with at least one golf tool removably coupled therewith.

2. The golf utility apparatus of claim 1, wherein the first and second rotational members are configured to rotate independently of each other.

3. The golf utility apparatus of claim 1, wherein the first and second rotational members are configured to rotate about a common axis relative to each other.

4. The golf utility apparatus of claim 1, wherein said at least one golf tool removably coupled to the third rotational member is selected from among a group of golf tools consisting of a divot repair tool, a range finder, a spike wrench, a ball marker, a golf tee, a fidget/focus device, and combinations thereof.

5. The golf utility apparatus of claim 1, wherein the second and third rotational members are mechanically coupled to rotate simultaneously.

6. The golf utility apparatus of claim 1, wherein the ball alignment tool and the third rotational member are mechanically coupled to rotate simultaneously.

7. The golf utility apparatus of claim 1, wherein the apparatus comprises a maximum width of 3.5 inches at its widest point, and a maximum height of 2 inches.

8. The golf utility apparatus of claim 1, wherein the apparatus comprises a maximum width of 1.75 inches at it's widest point, and a maximum height of 0.625 inches.

9. A golf utility apparatus comprising:

a. a ball alignment tool for aligning a putt on a putting green; and, b. a lower structural member mechanically coupled with said all alignment tool; wherein, c. the ball alignment tool is configured to rotate around a common axis with, but independently of, the lower structural member;

d. an upper structural member coupled with the lower structural member by a rigid mechanical coupling, the upper structural member having at least one golf tool, coupled thereto, said at least one golf tool coupled to the upper structural member being selected from among a second group of tools consisting of a divot repair tool, a range finder, a spike wrench, a ball marker, a golf tee, a fidget/focus device, and combinations thereof; and wherein, e. at least one tool is coupled to the lower structural member, said at least one tool coupled to the lower structural member being selected from among a first group of tools consisting of a divot repair tool, a range finder, a spike wrench, a ball marker, a golf tee, a fidget/focus device, and combinations thereof.

10. The golf utility apparatus of claim 9, wherein the rigid mechanical coupling between the upper structural member and the lower structural member prevents the lower structural member from rotating or moving independently of the upper structural member.

11. A golf utility apparatus comprising:

a. a first baseplate mechanically coupled with a golf ball alignment tool through a ball bearing interface, wherein the golf ball alignment tool is free to rotate independently from the first baseplate;

b. a divot repair tool having a handle and two tines releasably secured to the first baseplate; and c. a second baseplate mechanically coupled to the first baseplate;

d. wherein the divot repair tool comprises a handle and two tines, and wherein the handle of the divot repair tool comprises at least one slot configured to act as a rangefinder.

12. The golf utility apparatus of claim 11, wherein the first baseplate is mechanically coupled to the second baseplate through a rigid mechanical coupling, such that the first baseplate is prevented from moving or rotating independently of the second baseplate.

13. The golf utility of claim 11, further comprising at least one golf tool releasably secured to the second baseplate, said at least one golf tool being selected from among a group of tools consisting of a range finder, a spike wrench, a ball marker, a golf tee, a fidget/focus device, and combinations thereof.

* * * * *